United States Patent [19]

Abel et al.

[11] Patent Number: 4,902,439

[45] Date of Patent: Feb. 20, 1990

[54] DETERGENT COMPOSITION FOR WASHING OFF DYEINGS OBTAINED WITH FIBRE-REACTIVE DYES, PROCESS FOR THE PREPARATION THEREOF AND USE THEREOF

[75] Inventors: Heinz Abel, Reinach; Hans-Ulrich Berenut, Allschwil, both of Switzerland

[73] Assignee: Ciba-Geigy Corporation, Ardsley, N.Y.

[21] Appl. No.: 181,797

[22] Filed: Apr. 15, 1988

[30] Foreign Application Priority Data

Apr. 15, 1987 [CH] Switzerland ..... 1494/87-0

[51] Int. Cl.[4] ..... C11D 10/02

[52] U.S. Cl. ..... 252/174.25; 252/131; 252/140; 252/163; 252/164

[58] Field of Search ..... 252/131, 140, 154, 174.25, 252/163, 164

[56] References Cited

U.S. PATENT DOCUMENTS

| | | | |
|---|---|---|---|
| 3,692,684 | 9/1972 | Heutschel | 252/89.1 |
| 4,239,641 | 12/1980 | Perner et al. | 252/142 |
| 4,288,342 | 9/1981 | Wagner, III et al. | 252/140 |
| 4,299,738 | 11/1981 | Suzuki et al. | 252/140 |
| 4,303,556 | 12/1981 | Liendado | 252/140 |
| 4,311,607 | 1/1982 | Kaeser | 252/140 |
| 4,405,483 | 9/1983 | Kuzel et al. | 252/140 |
| 4,438,012 | 3/1984 | Kuhling et al. | 252/140 |
| 4,438,016 | 3/1984 | Kiewert et al. | 252/140 |
| 4,519,933 | 5/1985 | Gresser et al. | 252/140 |
| 4,545,919 | 10/1985 | Abel | 252/140 |
| 4,610,796 | 9/1986 | Chirash et al. | 252/140 |
| 4,637,891 | 1/1987 | Delwel et al. | 252/140 |
| 4,671,887 | 6/1987 | Diehl et al. | 252/140 |

FOREIGN PATENT DOCUMENTS

| | | |
|---|---|---|
| 0008060 | 2/1980 | European Pat. Off. . |
| 0102923 | 3/1984 | European Pat. Off. . |
| 2283221 | 3/1984 | France . |
| 1503363 | 3/1978 | United Kingdom . |

*Primary Examiner*—Paul Lieberman
*Assistant Examiner*—Willie Thompson
*Attorney, Agent, or Firm*—Edward McC. Roberts

[57] ABSTRACT

The invention relates to an aqueous detergent composition comprising (A) an aluminium silicate and (B) a trihydric alcohol and, as optional components, (C) an anionic surfactant and (D) a non-ionic surfactant to the use of said composition for washing off dyeings obtained on cellulosic fabrics with reactive dyes, and to the preparation thereof.

13 Claims, No Drawings

DETERGENT COMPOSITION FOR WASHING OFF DYEINGS OBTAINED WITH FIBRE-REACTIVE DYES, PROCESS FOR THE PREPARATION THEREOF AND USE THEREOF

The present invention relates to an aqueous detergent composition which can be used for washing off prints or dyeings obtained with reactive dyes on cellulosic textile fabrics, to a process for the preparation of said composition, and to the use thereof for washing off said textile fabrics on an industrial scale as well as in domestic use. The detergent composition of this invention is especially suitable for washing off with "hard" water such as mains water.

Detergent compositions which contain alkali aluminium silicates, anionic surfactants, non-ionic surfactants and thickeners are disclosed in U.S. patent specification 4 545 919. These compositions are used for washing off dyed materials in the form of piece-goods. However, these compositions are not suitable for washing off dyed material in the form of wound packages or of loose material. They are also less storage-stable.

Detergent compositions for washing off have now been found which do not have the shortcomings referred to above and which are also suitable for washing off fashioned articles such as garments.

The detergent composition of this invention comprises (A) An alkali aluminium silicate and (B) a trihydric to hexahydric alcohol.

In addition to component (A) and (B), the detergent composition of the invention can also comprise, as component (C), an anionic surfactant and, as component (D), a non-ionic surfactant.

In addition to components (A) and (B) and the optional components (C) and (D), the detergent compositions may also contain conventional auxiliaries and modifiers. The detergent compositions can further contain polymers or copolymers of an acrylamide.

Component (A), which constitutes the true active component of the novel detergent composition, is preferably a finely particulate water-insoluble alkali aluminium silicate of formula $$(Me_{2/n}O)_p \cdot Al_2O_3 \cdot (SiO_2)_q, \quad (1)$$

wherein Me is an alkali metal ion of valency n, preferably the sodium ion, n is 1 or 2, p is a number having a value from 0.7 to 1.5, and q is a number having a value from 0.8 to 6, preferably from 1.3 to 4.

The alkali aluminium silicates employed as component (A) may be synthesised in simple manner, for example by reacting water-soluble silicates with water-soluble aluminates in the presence of water. To this end, aqueous solutions of the starting materials are mixed with each other or one component, in the solid state, is mixed with the other component which is in the form of an aqueous solution. The desired aluminium silicates are also obtained by mixing both components, in the solid state, in the presence of water. Alkali aluminium silicates can also be prepared from $Al(OH)_3$, $Al_2O_3$ or $SiO_2$ by reaction with solutions of alkali silicates or aluminates. Finally, such substances can also be obtained from the melt.

The alkali aluminium silicates prepared by precipitation or other processes and converted, in finely particulate state, into aqueous suspensions can be converted by heating to temperatures from 50° to 200° C. from the amorphous into the denatured or into the crystalline state. The amorphous or crystalline alkali aluminium silicate, which is present in aqueous suspension, can be separated from the residual aqueous solution by filtration and, if desired, dried in the temperature range from e.g. 50° to 800° C.

The precipitation conditions make it possible to obtain particle sizes of a few microns by subjecting the combined aluminate and silicate solutions, which may also be introduced simultaneously into the reactor, to strong shearing forces, for example by stirring the suspension vigorously.

An undesirable agglomeration of crystal particles may still occur, so that it is advisable to remove these secondary particles in suitable manner, e.g. by air classification. It is also possible to use alkali aluminium silicates which are obtained in coarser form and which have been ground to the desired particle size using e.g. mills and/or air classifiers or combinations thereof.

Further particulars on the nature of the alkali aluminium silicates employed as component (A), including the preparation thereof, are disclosed in German Offenlegungsschrift 27 14 954. The alkali aluminium silicates prepared by the process of this invention have a particle size of 1 to 12μ.

Detergent compositions which contain alkali aluminium silicates of such particle size are very suitable for washing dyed materials which are in piece form such as wovens. Like the detergent compositions of the above mentioned U.S. Pat. No. 4,545,919, those of German Offenlegungsschrift No. 2 714 954 are also not suitable for washing off dyed materials in the form of wound packages such as cheeses, as the calcium silicate complexes which form are too large to penetrate the bulky dyed material in the washing process.

Accordingly, the present invention further relates to a process for the preparation of the novel detergent compositions, which process comprises charging an aqueous solution of component (B) to a stirred vessel, adding components (C), (D) and (A) with stirring, adding glass beads to the resultant mixture and grinding said mixture to a readily pourable microsuspension and then separating said suspension from the glass beads.

The grinding operation is carried out in the temperature range from 18° to 30° C. (room temperature) and takes several hours, preferably from 4 to 7, most preferably from 4.5 to 5.5, hours. The grinding (stirring) speed is 200 to 700 rpm, preferably 200 to 400 rpm.

The glass beads employed should be sufficiently large to grind the alkali aluminium silicates to a particle size of 0.01 to 2μ. The average size of the glass beads is 1.5 to 3 mm, preferably 2 mm.

Component (A) can also be ground in the absence of components (C) and (D).

The glass beads are separated from the grinding stock by methods which are known per se, for example by centrifugation.

Alcohols suitable for use as component (B) are typically glycerol, trimethylolpropane, 1,2,4-butanetriol, erythritol, mannitol, pentaerythritol, 1,2,5-hexanetriol, tetramethylol ethylenediamine and, in particular, sorbitol.

The anionic surfactants (C) are preferably acid derivatives of non-ionic or cationic alkylene oxide adducts, e.g. polyadducts of 2 to 100 moles of alkylene oxides, preferably of ethylene oxide and/or propylene oxide or also styrene oxide, with organic hydroxyl, carboxyl, amino and/or amido compounds containing aliphatic hydrocarbon radicals having a total of at least 4, preferably 12, carbon atoms, or mixtures of such compounds, which adducts contain acid ether groups or, preferably, acid ester groups of inorganic or organic acids. These acid ethers or acid esters can be in the form of the free acids or salts, e.g. alkali metal salts, alkaline earth metal salts, ammonium or amine salts.

These anionic surfactants are obtained by known methods, by addition of at least 2 mol, preferably of more than 2 mol, e.g. 10 to 100mol, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Very suitable anionic alkylene oxide polyadducts are acid esters, or acid ester salts, of a polyadduct of 2 to 100 mol, preferably up to 50 mol, of ethylene oxide with 1 mol of a fatty alcohol containing 8 to 22 carbon atoms, or with 1 mol of a phenol which contains at least one benzyl group, one phenyl group or preferably one alkyl group containing at least 4 carbon atoms, e.g. benzylphenol, dibenzylphenol, dibenzyl(nonyl)phenol, o-phenylphenol, butylphenol, tributylphenol, octylphenol, nonylphenol, dodecylphenol or pentadecylphenol, which acid esters may be used individually or in admixture. Preferred alkylene oxide polyadducts have the formula $$Y—O—(CH_2CH_2O)_{\overline{m}}X, \quad (2)$$

wherein Y is alkyl or alkenyl, each of 8 to 22 carbon atoms, alkylphenyl containing 4 to 16 carbon atoms in the alklyl moiety, or o-phenylphenyl, X is the acid radical of an inorganic oxygen-containing acid, e.g. sulfuric acid or phosphoric acid, or is also the radical of an organic acid, and m is 2 to 40, preferably 2 to 15. The alkyl moiety of alkylphenyl is preferably in the para-position, and can be butyl, hexyl, n-octyl, n-nonyl, p-tert-octyl, p-isononyl, decyl or dodecyl. Preferred alkyl radicals are those containing 8 to 12 carbon atoms, with octyl and nonyl being most preferred.

The fatty alcohols for obtaining the anionic surfactants of formula (2) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The acid radical X is derived for example from a low molecular dicarboxylic acid, e.g. from maleic acid, succinic acid or sulfosuccinic acid, and is linked to the oxyethylene part of the molecule through an ester bridge. Preferably, however, X is derived from an inorganic polybasic acid such as sulfuric acid or orthophosphoric acid. The acid radical X can be in the form of the free acid or in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Particularly preferred anionic surfactants are those of formula

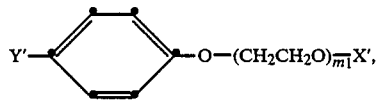

$$Y'—C_6H_4—O—(CH_2CH_2O)_{\overline{m_1}}X', \quad (3)$$

wherein Y' is octyl or nonyl, $m_1$ is 2 to 15, and X' is a radical derived from sulfuric acid or from o-phosphoric acid, which surfactants are in the form of free acids or sodium or ammonium salts. A particularly preferred anionic surfactant is the sulfuric acid monoester of the adduct of 2 to 12 mol of ethylene oxide with 1 mol of p-nonylphenol.

The anionic alkylene polyadducts can be used singly or in admixture for preparing the novel detergent composition of this invention.

The non-ionic surfactants employed as component (D) are, for example, alkylene oxide adducts of natural alcohols such as amyl alcohol, lauryl alcohol, myristyl alcohol, cetyl alcohol, stearyl alcohol or oleyl alcohol, or synthetic alcohols, e.g. oxo alcohols such as, in particular, 2-ethylbutanol, 2-ethylhexanol, isooctyl alcohol, trimethylhexanol, trimethylnonyl alcohol, hexadecyl alcohol or the fatty alcohols commercially available under the registered trademark Alfol®.

The alkylene oxide adducts obtained from the above water-insoluble monoalcohols, for example 1,2-propylene oxide adducts, e.g. those containing 1 to 15 mol of propylene oxide, but preferably the ethylene oxide adducts of these alcohols, can also be employed as component (D). Preferred ethylene oxide adducts are illustrated e.g. by the formula $$R—O—(CH_2CH_2O)_{\overline{s}}H \quad (4)$$

where R is a saturated or unsaturated aliphatic radical, preferably alkyl or alkenyl, each of 8 to 18 carbon atoms, and s is a value from 1 to 10, preferably 1 to 3.

Also suitable for use as component (D) are fatty acid/alkanolamine condensates which are preferably derived from $C_8$–$C_{22}$fatty acids and alkanolamines containing 2 or 3 carbon atoms in each alkanol moiety. The condensates of $C_{12}$–$C_{18}$fatty acids are preferred. A suitable alkanolamine is e.g. ethanolamine, diethanolamine, propanolamine, isopropanolamine or diisopropanolamine. Dialkanolamines, in particular diethanolamine, are preferred. The molar ratio of fatty acid to dialkanolamine may be 1:1 to 1:2. Examples of fatty acids are: decenoic acid, lauric acid, coconut fatty acid, myristic acid, palmitic acid, tallow fatty acid, oleic acid, ricinolic acid, linolic acid, linolenic acid, stearic acid, arachinic acid or behenic acid.

It is also possible to use the mixtures of these acids obtained by cleaving natural oils or fats. Mixtures of palmitic acid and stearic acid and, in particular, coconut fatty acid, are particularly preferred. The condensates of component (D) and their preparation are disclosed e.g. in U.S. Pat. No. 2,089,212.

Also suitable for use as component (D) are polyadducts of alkylene oxide, especially ethylene oxide, with the above mentioned fatty acid/alkanolamine condensates, individual ethylene oxide units of which polyadducts can be replaced by substituted epoxides such as propylene oxide. The number of alkylene oxide groups in these glycol ethers can be 1 to 8 and, preferably, 1 to 4. Preferred polyadducts are those of 1 to 4 mol of ethylene oxide with 1 mol of the reaction product of 1 mol of coconut fatty acid, stearic acid and/or palmitic acid with 1 mol of diethanolamine.

Further condensates suitable for use as component (D) are adducts of preferably 2 to 15 moles of alkylene oxide, e.g. ethylene oxide and/or propylene oxide, with unsubstituted or substituted phenols, trihydric to hexahydric aliphatic alcohols containing 3 to 9 carbon atoms, or with the fatty acids referred to above.

Examples of suitable unsubstituted or substituted phenols are phenol, o-phenylphenol or alkylphenols containing preferably altogether 4 to 16, most preferably 4 to 12, carbon atoms, in the alkyl moiety. Examples of these alkylphenols are: butylphenol, tributylphenol, octylphenol and, in particular, nonylphenol.

The trihydric to hexahydric alkanols contain preferably 3 to 6 carbon atoms and are in particular glycerol, trimethylolpropane, erythritol, mannitol, pentaerythritol and sorbitol. The trihydric to hexahydric alcohols are preferably reacted with ethylene oxide, or most preferably with propylene oxide, or with mixtures thereof.

The fatty acids contain preferably 8 to 22 carbon atoms and may be saturated or unsaturated, and are, for example, capric, lauric, myristic, palmitic or stearic acid, and decenoic, dodecenoic, tetradecenoic, hexadecenoic, aleic, linoleic, linolenic or, preferably, ricinolic acid.

The amounts in which component (D) is present in the detergent composition by itself or as a mixture of two, three or more components, varies from 0 to 10% by weight, preferably from 0.1 to 2% by weight, based on the entire composition.

The detergent composition of this invention may also contain, as component (E), an aliphatic monoalcohol containing not less than 5, preferably 8 to 18, carbon atoms. These alcohols may be saturated or unsaturated and branched or straight chain and can be used individually or in admixture. Such alcohols are typically the natural or synthetic alcohols referred to above.

The detergent compositions of this invention preferably comprise, in each case based on the mixture, 10–50% by weight of component (A)
15–65% by weight of component (B),
0–10% by weight of component (C),
0–5% by weight of component (D) and at least 10% of water.

Preferred detergent composition of this invention comprise (AA) a sodium aluminium silicate,
(BB) a hexahydric alcohol,
(CC) an aqueous solution of the ammonium salt of the acid sulfuric acid monoester of the adduct of 1 mol of p-tert-nonylphenol and 2 mol of ethylene oxide.
(DD) an adduct of 1 mol of p-tert-nonylphenol and 10 ml of ethylene oxide, and
a graft copolymer of acrylamide and the adduct of propylene oxide with glycerol.

If desired, such mixtures may additionally contain silicone oils.

The detergent compositions of this invention are used in particular for washing off dyeings or prints on cellulose fibres or blends of cellulose and synthetic organic material, e.g. linear polyesters or modified cellulose (cellulose acetates). Suitable cellulosic material is that made from natural or regenerated cellulose, e.g. hemp, linen, jute, viscose silk, viscose rayon or, in particular, cotton, and the polyester component, if present, is dyed before or after the cellulose. By dyeings and prints are meant in this context the dyeings and prints produced on cellulose by any methods with reactive dyes, the application of the detergent compositions being effected as an aftertreatment.

The dyed material may be in any form of presentation, e.g. as loose material (flocks), as folded prestretched staple slivers, or as filaments, yarns, and especially as wovens or knits. By reactive dyes are meant the conventional anionic dyes which form a chemical bond with cellulose, e.g. the dyes listed as "Reactive Dyes" in the Colour Index, 3rd Edition (1971), Vol. 3, on pages 3391–3562.

The detergent composition of this invention make it possible to carry out very satisfactorily the customary washing operations in connection with prints or dyeings produced with the above mentioned reactive dyes also with the hard water (process water) directly available from the mains. The water hardness is thereby eliminated without the usual addition of electrolytes, ion exchangers and/or chelating agents and, in particular, of phosphorus compounds, e.g. phosphonic acids or inorganic phosphates, the use of which has recently been increasingly restricted by environmental and legislative demands for phosphorus-free products.

The invention accordingly further relates to a process for washing off prints or dyeings produced with reactive dyes on cellulosic textile materials, which process comprises the use of the detergent compositions of this invention. This process comprises treating the printed or dyed textiles, in the temperature range from 60° to 100° C., in an aqueous wash liquor which contains a detergent composition of the invention, preferably in an amount from 1 to 10 g/l. The textiles are then removed from the wash liquor and rinsed with fresh water until the constituents of the wash liquor have been completely removed. The white ground of the prints obtained is not stained, and the dyeings obtained by the exhaust process have the desired wetfastness properties, in particular washfastness.

In the following Preparatory Method and Examples, parts and percentages are by weight.

The following adducts are examples of the anionic surfactants and alkylene oxide adducts employed as components (C) and (D) respectively:

Anionic surfactants $C_1$ the ammonium salt of the sulfuric acid monoester of the adduct of 2 mol of ethylene oxide and 1 mol of alfol (1014);
$C_2$ the ammonium salt of the sulfuric acid monoester of the adduct of 2 mol of ethylene oxide and 1 mol of stearyl alcohol;
$C_3$ the ammonium salt of the sulfuric acid monoester of the adduct of 3 mol of ethylene oxide and 1 mol of 2-ethylhexanol;
$C_4$ the ammonium salt of the sulfuric acid monester of the adduct of 15 mol of ethylene oxide and 1 mol of stearyl alcohol;

$C_5$ the ammonium salt of the sulfuric acid monoester of the adduct of 3 mol of ethylene oxide and 1 mol of tridecyl alcohol;

$C_6$ the ammonium salt of the sulfuric acid monoester of the adduct of 4 mol of ethylene oxide and 1 mol of hydroabietyl alcohol;

$C_7$ the ammonium salt of the sulfuric acid monoester of the adduct of 3 mol of ethylene oxide and 1 mol of alfol (2022);

$C_8$ the ammonium salt of the sulfuric acid monoester of the adduct of 3 mol of ethylene oxide and 1 mol of lauryl alcohol;

$C_9$ the di-($\beta$-hydroxyethyl)amine salt of the sulfuric acid monoester of the adduct of 3 mol of ethylene oxide and 1 mol of lauryl alcohol;

$C_{10}$ the sodium salt of the sulfuric acid monoester of the adduct of 2 mol of ethylene oxide and 1 mol of lauryl alcohol;

$C_{11}$ the sodium salt of the sulfuric acid monoester of the adduct of 3 mol of ethylene oxide and 1 mol of lauryl alcohol;

$C_{12}$ the phosphoric acid monoester of the adduct of 5 mol of ethylene oxide and 1 mol of 2-ethyl-n-hexanol;

$C_{13}$ the ammonium salt of the sulfuric acid monester of the adduct of 3 mol of ethylene oxide and 1 mol of butylphenol;

$C_{14}$ the ammonium salt of the sulfuric acid monoester of the adduct of 5 mol of ethylene oxide and 1 mol of tributylphenol;

$C_{15}$ the ammonium salt of the sulfuric acid monoester of the adduct of 2 mol of ethylene oxide and 1 mol of nonylphenol;

$C_{16}$ the ammonium salt of the sulfuric acid monoester of the adduct of 10 mol of propylene oxide and 10 mol of ethylene oxide and 1 mol of nonylphenol;

$C_{17}$ the ammonium salt of the sulfuric acid monoester of the adduct of 35 mol of ethylene oxide and 1 mol of nonylphenol;

$C_{18}$ the ammonium salt of the sulfuric acid monoester of the adduct of 50 mol of ethylene oxide and 1 mol of nonylphenol;

$C_{19}$ the ammonium salt of the sulfuric acid monoester of the adduct of 15 mol of propylene oxide and 1 mol of nonylphenol;

$C_{20}$ the ammonium salt of the sulfuric acid monoester of the adduct of 6 mol of ethylene oxide and 1 mol of dodecylphenol;

$C_{21}$ the ammonium salt of the sulfuric acid monoester of the adduct of 6 mol of ethylene oxide and 1 mol of pentadecylphenol;

$C_{22}$ the ammonium salt of the sulfuric acid monoester of the adduct of 8 mol of ethylene oxide and 1 mol of o-phenylphenol;

$C_{23}$ the sodium salt of the maleic acid monoester of the adduct of 2 mol of ethylene oxide and 1 mol of p-nonylphenol;

$C_{24}$ the sodium salt of the sulfosuccinic acid monoester of the adduct of 2 mol of ethylene oxide and 1 mol of p-nonylphenol;

$C_{25}$ the ammonium salt of the phosphoric acid monoester of the adduct of 2 mol of ethylene oxide and 1 mol of nonylphenol;

$C_{26}$ the sodium salt of the sulfuric acid monoester of the adduct of 12 mol of ethylene oxide and 1 mol of dibenzylphenol;

$C_{27}$ the sodium salt of the sulfuric acid monoester of the adduct of 15 mol of ethylene oxide and 1 mol of dibenzyl(nonyl)phenol;

$C_{28}$ the phosphoric acid monoester of the adduct of 10 mol of ethylene oxide and 1 mol of p-nonylphenol;

$C_{29}$ the ammonium salt of the sulfuric acid monoester of the adduct of 15 mol of ethylene oxide and 1 mol of $\beta$-hydroxyethylstearamide;

$C_{30}$ the ammonium salt of the sulfuric acid diester of the adduct of 3 mol of ethylene oxide and 1 mol of lauryl alcohol;

$C_{31}$ the ammonium salt of the sulfuric acid diester of the adduct of 8 mol of ethylene oxide and 1 mol of tallow fatty amine;

$C_{32}$ the ammonium salt of the sulfuric acid diester of the adduct of 3 mol of propylene oxide and 5 mol of ethylene oxide and 1 mol of tallow fatty amine;

$C_{33}$ the ammonium salt of the phosphoric acid diester of the adduct of 8 mol of ethylene oxide and 1 mol of tallow fatty amine;

$C_{34}$ the ammonium salt of the sulfuric acid diester of the adduct of 1 mol of styrene oxide and 8 mol of ethylene oxide and 1 mol of dodecylamine;

$C_{35}$ the sodium salt of the sulfosuccinic acid hemiester of the adduct of 8 mol of ethylene oxide and 1 mol of tallow fatty amine;

$C_{36}$ the ammonium salt of the sulfuric acid diester of the adduct of 2 mol of ethylene oxide and 1 mol of stearylamine;

$C_{37}$ a 1:2 mixture of the phosphoric acid mono- and diester of the adduct of 8 mo of ethylene oxide and 1 mol of dodecylamine;

C"a 1:2 mixture of the phosphoric acid mono- and diester of the adduct of 4 mol of ethylene oxide and 1 mol of laurylamine.

Non-Ionic surfactants $D_1$ the polyadduct of 6 mol of ethylene oxide and 1 mol of 2-ethyl-n-hexanol;

$D_2$ the polyadduct of 5 mol of ethylene oxide and 1 mol of 2-ethyl-n-hexanol;

$D_3$ the polyadduct of 15 mol of ethylene oxide and 1 mol of stearyl alcohol;

$D_4$ the polyadduct of 3 mol of ethylene oxide and 1 mold of alfol (8-10);

$D_5$ the polyadduct of 5 mol of ethylene oxide and 1 mol of hexadecyl alcohol;

$D_6$ the polyadduct of 15 mol of ethylene oxide and 1 mol of oleyl alcohol;

$D_7$ the polyadduct of 6 mol of ethylene oxide and 2 mol of butylphenol;

$D_8$ the polyadduct of 4 mol of ethylene oxide and 2 mol of p-cresol;

$D_9$ the polyadduct of 5 mol of ethylene oxide and 1 mol of tributylphenol;

$D_{10}$ the polyadduct of 8 mol of ethylene oxide and 1 mol of octylphenol;

$D_{11}$ the polyadduct of 2 mol of ethylene oxide and 1 mol of nonylphenol;

$D_{12}$ the polyadduct of 10 mol of ethylene oxide and 1 mol of p-nonylphenol;

$D_{13}$ the polyadduct of 10 mol of ethylene oxide and 10 mol of propylene oxide and 1 mol of nonylphenol;

$D_{14}$ the polyadduct of 10 mol of ethylene oxide and 1 mol of oleyl alcohol;

$D_{15}$ the polyadduct of 12 mol of ethylene oxide and 1 mol of oleic alcohol;

$D_{16}$ the polyadduct of 8 mol of ethylene oxide and 1 mol of o-phenylphenol;

$D_{17}$ the polyadduct of 5 mol of ethylene oxide and 5 mol propylene oxide with 1 mol of alfol 12–14;

$D_{18}$ the polyadduct of 15 mol of ethylene oxide and 1 mol of castor oil;

$D_{19}$ the polyadduct of 8 mol of propylene oxide and 1 mol of pentaerythritol;

$D_{20}$ the polyadduct of 15 mol of ethylene oxide and 15 mol of propylene oxide with 1 mol of glycerol;

$D_{21}$ the polyadduct of 7 mol of ethylene oxide and 1 mol of $C_9$–$C_{11}$oxo alcohol;

$D_{22}$ the polyadduct of 15 mol of ethylene oxide and 1 mol of p-nonylphenol;

$D_{23}$ the polyadduct of 2 mol of ethylene oxide and 1 mol of coconut fatty acid (N,N-bis-β-hydroxyethyl)amide;

$D_{24}$ the polyadduct of 5 mol of ethylene oxide and 1 mol of p-nonylphenol;

$D_{25}$ the polyadduct of 15 mol of propylene oxide and 1 mol of glycerol.

Instruction A

The following components are mixed at room temperature and with constant stirring at 300 rpm in a stirred vessel equipped with a steel stirrer:

30.0% by weight of sodium aluminium silicate
0.15% by weight of anionic surfactant $C_{15}$
0.7% by weight non-ionic surfactant surfactant $D_{12}$
45.5% by weight of sorbitol
23.45% by weight of water.

To the homogeneous mixture are then added 200 g of glass beads having a diameter of 2.0 mm and the mixture is ground for 5 hours. The grinding stock is then separated from the glass beads by centrifugation, affording a readily pourable grey dispersion having an average particle size of 1.3μ. Comparable readily pourable dispersions are obtained by using, in place of sorbitol, the same number of parts of glycerol, of an ethoxylated pentaerythritol (mol. wt. 500–700) or of an ethoxylated tetramethylol ethylenediamine (mol. wt. 400–600).

Instruction B

The following components are mixed at room temperature and with constant stirring at 300 rpm in a stirred vessel equipped with a steel stirrer:

45.0% by weight of sodium aluminium silicate
1.5% by weight of anionic surfactant $C_{15}$
0.7% by weight of non-ionic surfactant $D_{12}$
10.5% by weight of sorbitol
0.4% by weight of a graft polymer of acrylamide and the adduct of propylene oxide and glycerol (mol. wt. 4200)
41.9% by weight of water.

To the homogeneous mixture are then added 200 g of glass beads having a diameter of 2.0 mm and the mixture is ground for 5 hours'The grinding stock is then separated from the glass beads by centrifugation, affording a readily pourable grey dispersion having an average particle size of 1.3μ.

EXAMPLE 1

(A) Bleached cotton terry cloth is printed on a roller printing machine with 1 kg of a printing paste of the following composition:

400 g of a 5% alginate thickener
100 g of urea
50 g of a dye of formula

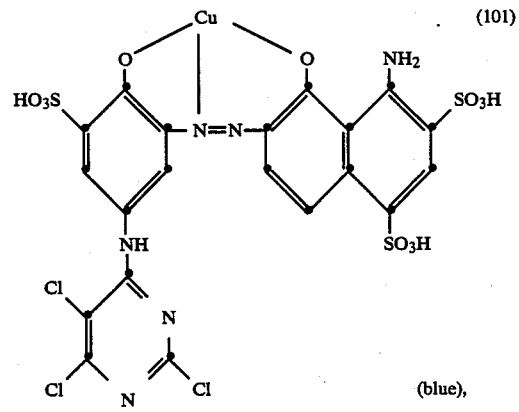

(101)

(blue), 10 g of m-nitrobenzene sulfonic acid (sodium salt)
60 g of 30% sodium carbonate solution, and
380 g of water such that 3 cm printed stripes alternate with 3 cm unprinted stripes. The goods are then dried and steamed for 8 minutes at 101° C.

The goods are then rolled up and used for the following test: (B) The following 3 washing liquors, each of 150 ml, are heated to boiling temperature:

1. water of 10° German hardness (dH)
2. water of 10° dH+4 ml/l of the formulation of Instruction A.
3. water of 10° dH+8 ml/l of the formulation of Instruction A.

Three samples printed according to Instruction A are put separately in succession into each of these washing liquors at a liquor to goods ration of 1:60 and treated for 5 minutes at boiling temperature, then rinsed in cold a water and dried in the air.

Fabric which is not stained on the unprinted areas is obtained with washing liquors 2 and 3, whereas the white area of the printed fabric treated with washing liquor is strongly stained.

EXAMPLE 2

(A) In a closed dyeing machine, 1 kg of cotton yarn (bleached) is wetted in 40 liters of water to which are added 30 g of a dye of formula

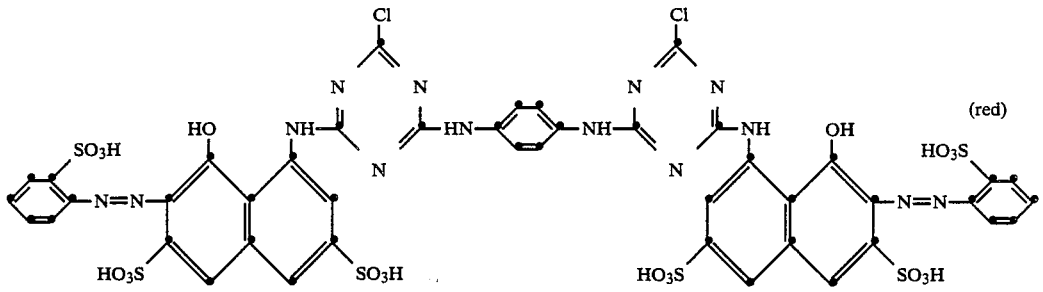

(102)

3.2 g of sodium chloride and 80 g of sodium m-nitrobenzenesulfonate. The dye liquor is then heated to 80° C. and the dyebath is kept at this temperature for 30 minutes. The liquor is then cooled to 60° C. over 30 minutes. The 800 g of sodium carbonate and 120 ml of 30% sodium hydroxide solution are added to the dye liquor and the yarn is dyed for 40 minutes at 60° C. The liquor is then cooled and the dyed goods are rinsed and dried.

(B) Three hanks of cotton dyed in accordance with A) are treated separately in an Ahiba dyeing machine at a liquor to goods ratio of 1:50 for 10 minute at boiling temperature in each of the following 3 washing liquors:

1. water of 10° dH
2. water of 10° dH+4 ml/l of the composition of Instruction A
3. water of 10° dH+8 ml/l of the composition of Instruction A.

The individual washed samples are subsequently rinsed together for 10 minutes in cold Permutite water.

The treated dyed samples are spin-dried to 100% water uptake and tested for fastness to wet pressing in accordance with SNV Standard 19832. To this end, a white cotton sample is wetted in distilled water and spin-dried to 100% water uptake. The moist dyed yarn is laid on a dry white hank of cotton and covered with the moist white sample. The samples are then pressed together for 2 minutes in a steam press heated to 180° C. The white prewetted adjacent fabric is then assessed for its fastness to wet pressing.

The dyed samples treated in washing tests 2 and 3 do not stain the white sample in the test for fastness for wet pressing, whereas the white cotton fabric is strongly strained by the sample treated in washing test 1.

EXAMPLE 3:

Untreated cotton knit fabric having a mass per unit area of 165 g/m$^2$ is impregnated on a pad at 25° C. with a liquor which contains 50 g/l of the dye of formula

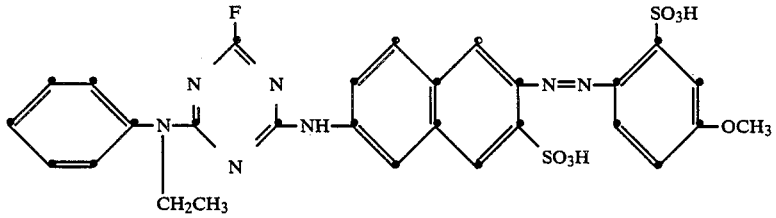

2.5 g/l of a wetting agent consisting of the sodium salt of pentadecane-1-sulfonic acid and the adduct of a 4 mol of ethylene oxide with 1 mold of a $C_9$-$C_{12}$primary alcohol in the weight ratio of 3:1, 10 ml/l of a graft polymer prepared in accordance with Instruction 2 of EP-B-111454, 10 ml/l of 30% sodium hydroxide solution, and 75 ml/l of sodium silicate solution having a silicate content of 26.3–27.7%.

After an immersion time of 0.86 second and at a roller pressure of 1.5 bar/cm$^2$, the liquor pick-up is 107% (based on the dry weight of the substrate). The goods are then rolled up and stored for 6 hours at 25° C. Three washing liquors, each of 150 ml, are then heated to boiling temperature:

1. water of 10° German hardness (dH)
2. water of 10° dH+4 ml/l of the formulation of Instruction B
3. water of 10° dH+8 ml/l of the formulation of Instruction B.

Three printed samples are put separately in succession into each of these washing liquors at al liquor to goods ratio 1:60 and treated for 5 minutes at boiling temperature, then rinsed in cold water and dried in the air.

Adjacent fabric is not stained after treatment with washing liquors 2 and 3, whereas adjacent fabric treated with washing liquor 1 is strongly stained.

We claim:

1. A detergent composition consisting of as active ingredients (A) 10–50% by weight of an alkali aluminium silicate, (B) 15–65% by weight of a trihydric to hexahydric alcohol, (C) 0–10% by weight of an anionic surfactant, (D) 0–5% by weight of a non-ionic surfactant, and (E) 0–0.4% by weight of a graft polymer of acrylamide and the adduct of propylene oxide and glycerol.

2. A detergent composition according to claim 1, wherein component (A) is a water-insoluble alkali aluminium silicate of formula $$(Me_{2/n}O)_p \cdot Al_2O_3 \cdot (SiO_2)_q$$

wherein Me is an alkali metal ion of valency n, n is 1 or 2, p is a number having a value from 0.7 to 1.5, and q is a number having a value from 0.8 to 6.

3. A detergent composition according to claim 1, wherein component (B) is selected from the group consisting of glycerol, trimethylolpropane, 1,2,4-butanetriol, erythritol, mannitol, pentaerythritol, 1,2,6-hexanetriol, tetramethylol ethylenediamine and sorbitol.

4. A detergent composition according to claim 1, wherein component (C) is an anionic alkylene oxide polyadduct of formula $$Y—O—(CH_2CH_2O)_{\overline{m}}X,$$

wherein in Y is alkyl or alkenyl, each of 8 to 22 carbon atoms, alkylphenyl containing 4 to 16 carbon atoms in the alkyl moiety, or o-phenylphenyl, X is the acid radical of an inorganic oxygen-containing acid, or is the radical of an organic acid, and m is 2 to 40, said acid radical X being in the form of the free acid or in salt form.

5. A detergent composition according to claim 4, wherein component (C) is an anionic surfactant of formula

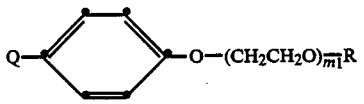

where Q is octyl or nonyl, $m_1$ is 2 to 15, and R is a radical derived from sulfuric acid or from o-phosphoric acid, which surfactant is in the form of the free acid or of the sodium or ammonium salt.

6. A detergent composition according to claim 1, wherein component (C) is an adduct of an unsubstituted or substituted phenol and 2 to 12 mol of ethylene oxide.

7. A detergent composition according to of claim 1, wherein component (D) is a fatty acid/alkanolamine condensate or an alkylene oxide adduct derived from a monoalcohol of 5 to 12 carbon atoms or fatty acid/alkanolamine condensate, or from a fatty acid of 8 to 22 carbon atoms, a trihydric to hexahydric aliphatic alcohol or an unsubstituted or substituted phenol.

8. A detergent composition according to claim 1 which comprises (AA) a sodium aluminium silicate, (BB) a hexahydric alcohol, (CC) an aqueous solution of the ammonium salt of the sulfonic acid monoester of the adduct of 1 mol of p-tert-nonylphenol and 2 mol of ethylene oxide, (DD) an adduct of 1 mol of p-tert-nonylphenol and 10 ml of ethylene oxide, and a graft copolymer of acrylamide and the adduct of propylene oxide with glycerol.

9. A detergent composition according to claim 8, wherein component (BB) is sorbitol.

10. A process for the preparation of a detergent composition as claimed in claim 1, which comprises charging an aqueous solution of component (B) to a stirred vessel, adding components (C), (D) and (A) with stirring, adding glass beads to the resultant mixture and grinding said mixture to a readily pourable microsuspensions and then separating said suspension from the glass beads.

11. A process according to claim 10, wherein the grinding operation is carried out in the temperature range from 15° to 30° C. and at a grinding speed of 250 to 500 rpm.

12. A process for washing off prints or dyeings produced with reactive dyes on cellulosic textile materials, which process comprises treating the printed or dyed textiles at a temperature in the range from 60° to 100° C. with an aqueous wash liquor which contains a detergent composition as defined in claim 1.

13. A process according to claim 12, wherein the the wash liquor contains the detergent composition in an amount from 1 to 10 g/l.

* * * * *

UNITED STATES PATENT AND TRADEMARK OFFICE

CERTIFICATE OF CORRECTION

PATENT NO. : 4,902,439

DATED : Feb. 20, 1990

INVENTOR(S) : Heinz Abel et al.

It is certified that error appears in the above-identified patent and that said Letters Patent is hereby corrected as shown below:

ON TITLE PAGE:

Line [75] Should read:

Heinz Abel, Reinach; Hans-Ulrich Berendt, Allschwil, both of Switzerland

Signed and Sealed this

Twenty-second Day of October, 1991

*Attest:*

*Attesting Officer*

HARRY F. MANBECK, JR.

*Commissioner of Patents and Trademarks*